US005496196A

United States Patent [19]

Schachtebeck

[11] Patent Number: 5,496,196

[45] Date of Patent: Mar. 5, 1996

[54] CDDI CONNECTOR FOR HIGH-SPEED NETWORKS OF VOICE AND DATA TRANSMISSIONS

[75] Inventor: Winfried Schachtebeck, Berlin, Germany

[73] Assignee: Krone Aktiengesellschaft, Berlin-Zehlendorf, Germany

[21] Appl. No.: 161,895

[22] Filed: Dec. 3, 1993

[30] Foreign Application Priority Data

Dec. 9, 1992 [DE] Germany ..... 42 42 404.6

[51] Int. Cl.[6] ..... H01R 13/10

[52] U.S. Cl. ..... 439/682

[58] Field of Search ..... 439/682, 692, 439/694, 660, 668, 669, 589, 607, 608, 924, 680

[56] References Cited

U.S. PATENT DOCUMENTS

| | | | |
|---|---|---|---|
| 3,125,395 | 3/1964 | Swanson | 439/589 |
| 3,425,024 | 1/1969 | Moulin | 439/589 |
| 3,497,866 | 2/1970 | Patton, Jr. | 439/680 |
| 3,665,509 | 5/1972 | Elkins | 439/271 |
| 4,193,655 | 3/1980 | Herrmann, Jr. | 439/589 |
| 4,549,036 | 10/1985 | Reichbach | 439/924 |
| 4,849,944 | 7/1989 | Matsushita | 439/924 |
| 4,974,075 | 11/1990 | Nakajima | 439/607 |

FOREIGN PATENT DOCUMENTS

| | | | |
|---|---|---|---|
| 2225905 | 6/1990 | United Kingdom | 439/924 |

*Primary Examiner*—Gary F. Paumen
*Assistant Examiner*—Hien D. Vu
*Attorney, Agent, or Firm*—McGlew & Tuttle

[57] ABSTRACT

The present invention relates to a connector for high-speed networks of the voice and data transmission (CDDI connectors). The object of the present invention, namely to develop a CDDI connector with electrical properties which are improved and which guarantees that the requirements for high-speed network components are met, is achieved by the arrangement of the contacts on an inner and on a middle circle.

10 Claims, 1 Drawing Sheet

CDDI CONNECTOR FOR HIGH-SPEED NETWORKS OF VOICE AND DATA TRANSMISSIONS

FIELD OF THE INVENTION

The invention relates to a copper distributed data interface (CDDI) connector for high-speed networks of voice and data transmissions in the connected distribution and connector box area of the high speed networks, and in particular to a CDDI connector in which the electrical properties of the connector are specifically designed to improve the cross talk attenuation, insertion loss and reflection attenuation.

BACKGROUND OF THE INVENTION

Connectors for high-speed networks are generally known in the art. The so-called CDDI connectors (copper distributed data interface) or FDDI connectors (fibre distributed data interface), resp., are employed in data networks for transmission paths at 100 megabits/s. The prior art connectors (in "KRONE LINK with LSA Profile", Planning Instructions, edition 06.92) comprise a generally rectangular housing. In one example 8 contacts are disposed pair-wise and are arranged in parallel to each other, with their relatively large contact surfaces. Between the contact surfaces of each contact pair is provided a plastic core. This contact surface arrangement results in a capacitance effect negatively affecting important electrical parameters of the connector, such as cross-talk attenuation. Further electrical parameters are negatively affected, such as the characteristic impedance and the reflection attenuation, which are caused by the necessary separation of the supply cable, due to the constructional conditions, and by the interruption of the optimized cable structure.

SUMMARY AND OBJECTS OF THE INVENTION

It is therefore the object of the present invention to develop a CDDI connector of the type referred to hereinbefore, the electrical properties of which are improved and which guarantees that the requirements for high-speed network components are met.

The solution of this object is achieved by the arrangement of the contacts on an inner and on a middle circle. The configuration of the CDDI connector having a circular cross-section corresponds to the cable structure of the supply cable in a better way than the prior art rectangular form. The circular contact arrangement guarantees maximum distances of the individual wires from each other. By using preferably round contact elements, similar to those used for the bases of integrated circuits, IC chips, and by using a wire as the connection between the rear contact of the employed quick-terminate technique (LSA PLUS contact) and the respective plug contact, the respective coupling capacitances between the contacts are reduced to minimum values. The properties of the connector with regard to crosstalk attenuation and insertion loss are substantially improved. The design of the connector permits the termination of the wires in two planes, thus the respective cable structure of the supply cable being generally maintained. The connection axis between the incoming wire and the plug contact is 180°, so that electrical discontinuities are reduced. The values for the characteristic impedance and the reflection attenuation are improved. This effect is still increased, if identical diameters for the incoming wire and the plug contact are employed. By the circular design of the connector, a tube-type construction of the shielding is possible. Thus achievable closed and homogeneous shielding results in an improved transfer impedance. With prior art connectors, an inhomogeneous, open structure could only be obtained. The CDDI connector of the present invention is simple and economical to manufacture due to its simple construction.

The various features of novelty which characterize the :invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
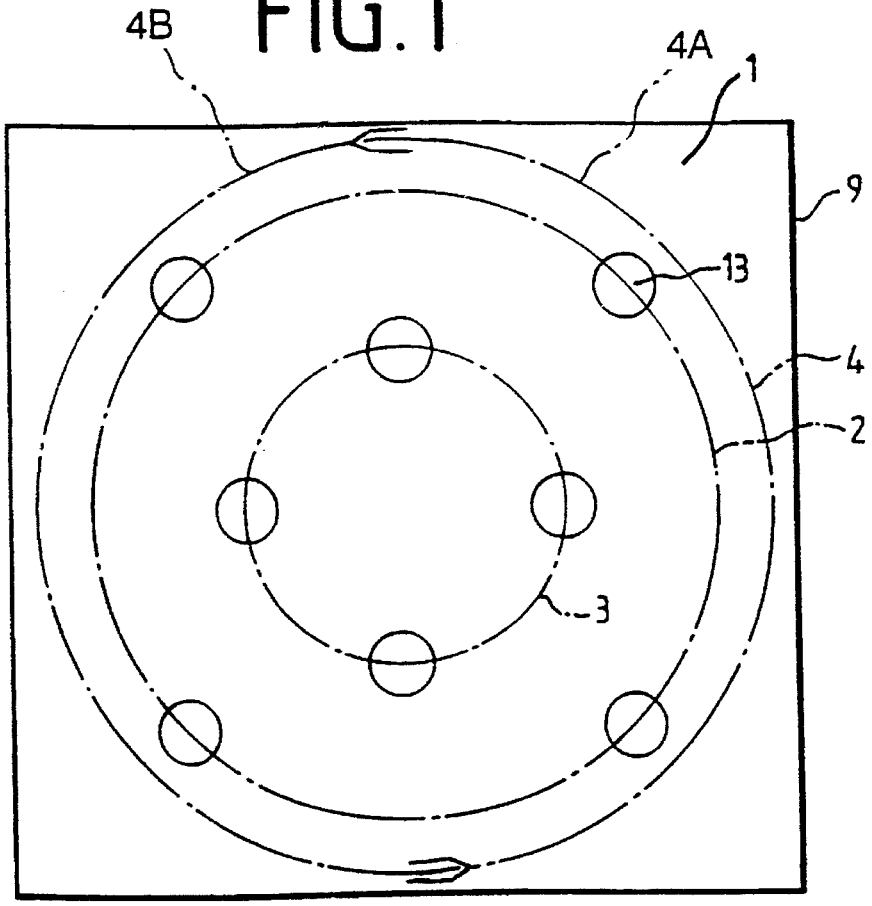
FIG. 1 a diagrammatical top view of a CDDI connector.

Referring now to FIG. 1, there is shown, in a diagrammatical representation, the top view of a CDDI connector 1, which includes a housing 9, a middle contact circle 2 with four contact elements 13, an inner contact circle 3 with four contacts and a shielding 4 as an outer circle. By this basic arrangement of the individual contact elements 13, an eight-wire arrangement is possible.

Figure 2:
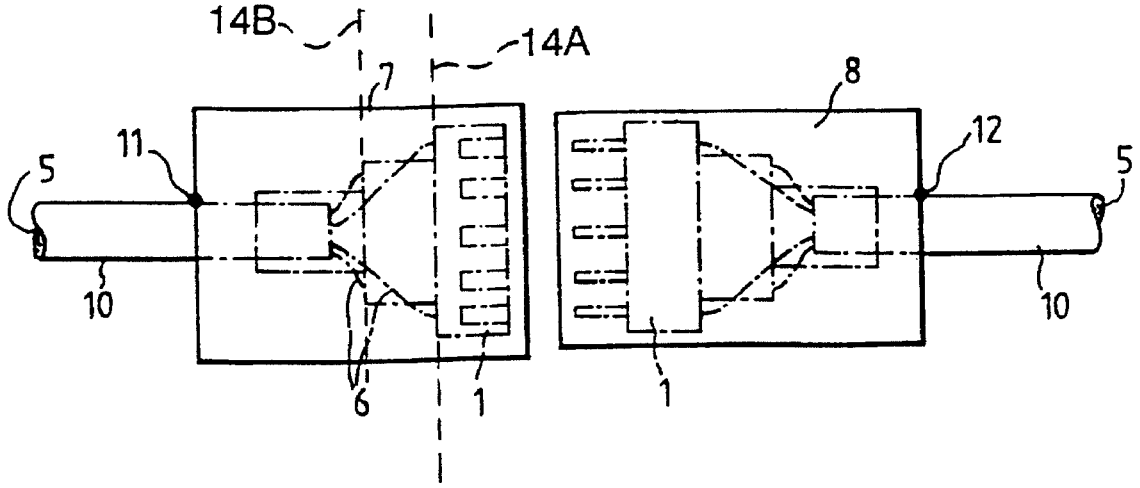
FIG. 2 a diagrammatical side view of an arrangement of a socket and plug of a CDDI connector having the shielding.

In FIG. 2, the configurations of a socket 7 and of a plug 8 of the CDDI connector 1 are diagrammatically shown in a side view. The supplied cable 5 is conducted into the housing 9 of the socket 7 and to the connector 1. The cable wires 6 of the cable 5 are connected to the contact elements 13. In the same way, the introduction and connection of the cable 5 and of the cable wires 6 on the side of the plug 8 are performed.

Minimization of the coupling capacitances between the contact elements 13, is caused by the circular configuration of the four (4) contact elements 13 in each of the inner and middle circles 3, 2 and the utilization of round plug contacts with a wire having for instance a diameter of 0.6 mm as the connection between the not shown rear contact in a quick-terminate technique (LSA PLUS contact) and the respective plug contact, Thereby, minimizing electrical properties with regard to crosstalk application of the CDDI connector 1 in a frequency range of 20 to 140 MHz.

From the representation in FIG. 2, it can be seen that the connector 1 permits the termination of the wires 6 in two planes 14A and 14B. By this arrangement, the respective cable structure is substantially maintained. The connection axis between the incoming wire and the plug contact is substantially 180°, so that electrical discontinuities are reduced. The circular arrangement of the connector guarantees a tube-type construction of the shielding. Thereby, a closed and homogeneous shielding is achieved, which results in particular in an improved transfer impedance (FIGS. 1, 2). The shielding 11 of the socket housing 7 and the shielding 12 of the plug housing 8 are connected to the respective shielding of the cables 5. The tube-type shielding 4 of the connector 1 can be composed of two half-shells 4A and 4B, similar to dipole sockets.

The CDDI connector 1 can be employed, as an individual-cable connector, in patch fields in communication distributors, for computers, telephones and the like, in conjunction with the insulation displacement technique LSA PLUS (quick-terminate technique).

While specific embodiments of the invention have been shown and described in detail to illustrate the application of the principles of the invention, it will be understood that the invention may be embodied otherwise without departing from such principles.

What is claimed is:

1. A copper distributed data interface (CDDI) connector for the connector distribution and connection box area of high-speed networks of voice and data transmissions, the connector comprising:

a plurality of contact elements positioned about a first circle and a second circle, said first and second circles being substantially concentric and said first circle being smaller and inside said second circle, said plurality of contact elements includes only four (4) contact elements arranged on said first circle and only four (4) contact elements arranged on said second circle, a wire termination of said plurality of contact elements positioned about said first circle are in a plane spaced from another plane containing a wire termination of said plurality of contact elements positioned about said second circle, each of said contact elements on said first circle is at an angular position substantially halfway between angular positions of adjacent said contact elements on said second circle, each of said contact elements on said second circle is at an angular position substantially halfway between angular positions of adjacent said contact elements on said first circle.

2. A connector according to claim 1, wherein:

said contact elements are round plug contacts.

3. A connector according to claim 1, wherein:

said contact elements connect to a respective wire along a connection axis between each contact element and each wire which is substantially 180°.

4. A connector according to claim 3, wherein:

a diameter of said contact elements is substantially similar to a diameter of said wire.

5. A connector according to claim 1, further comprising:

tube-type shielding positioned in a third circle, said third circle being substantially concentric with and outside said first and second circles.

6. A connector according to claim 5, wherein:

said shielding is composed of two half-shells.

7. A connector in accordance with claim 1, further comprising:

a first set of a plurality of wires connected to said contact elements positioned on said first circle and terminating in a first plane;

a second set of plurality of wires connected to said contact elements positioned on said second circle and terminating in a second plane, said second plane being spaced from said first plane in an axial direction of the connector;

said first and second set of plurality of wires forming a connection with said plurality of contact elements along a connection axis between each contact element and each wire which is substantially 180° in order to reduce electrical discontinuities, and to improve impedance and reflection attenuation characteristics.

8. A connector in accordance with claim 7, wherein:

said plurality of wires are in an optimized cable structure for CDDI;

said wire terminations of said first and second circles are positioned on said first and second circles, in said axially spaced planes, to maintain said optimized cable structure for CDDI.

9. A copper distributed data interface (CDDI) connector for the connector distribution and connection box area of high-speed networks of voice and data transmissions, the connector comprising:

a plurality of only four contact elements positioned about a first circle and only four contact elements arranged on a second circle, said first and second circles being substantially concentric, and said first circle being smaller and inside said second circle and said plurality of contact elements are arranged on said first and second circles in order to position said plurality of contact elements at maximum distances from each other and to minimize coupling capacitances between said plurality of contact elements, each of said contact elements on said first circle is at an angular position substantially halfway between angular positions of adjacent said contact elements on said second circle, each of said contact elements on said second circle is at an angular position substantially halfway between angular positions of adjacent said contact elements on said first circle;

a plurality of wires having a diameter substantially similar to a diameter of said contact elements and forming a connection with said plurality of contact elements along a connection axis between each contact element and each wire which is substantially 180° in order to reduce electrical discontinuities, and to improve impedance and reflection attenuation characteristics, a first set of said plurality of wires terminate at said contact elements positioned on said first circle in a first plane, a second set of said plurality of wires terminate at said contact elements positioned on said second circle and in a second plane spaced from said first plane;

tube-type shielding positioned in a third circle, said third circle being substantially concentric with, and outside, said first and second circles to form closed and homogeneous shielding.

10. A connector in accordance with claim 9, wherein:

said plurality of wires are in an optimized cable structure for CDDI;

said wire terminations of said first and second circles are positioned on said first and second circles, in said axially spaced planes, to maintain said optimized cable structure for CDDI.

* * * * *